US006238116B1

(12) United States Patent
Smith et al.

(10) Patent No.: US 6,238,116 B1
(45) Date of Patent: May 29, 2001

(54) FOAM APPLICATOR WITH WIPER INSERT

(75) Inventors: Alexander Rhodes Smith, Fountain Inn, SC (US); Gary R. Ashe, Sanborn, NY (US); Roger F. Lockshier, Monroe; James Whitaker, Jr., New Haven, both of CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/302,951

(22) Filed: Apr. 30, 1999

(51) Int. Cl.[7] ..... A46B 11/00
(52) U.S. Cl. ..... 401/122; 401/127; 401/199
(58) Field of Search ..... 401/122, 198, 401/199, 127

(56) References Cited

U.S. PATENT DOCUMENTS

| | | | |
|---|---|---|---|
| D. 123,237 | 10/1940 | Schmucker . | |
| 159,067 | 1/1875 | Blydenburgh . | |
| 164,912 | 6/1875 | Forbes . | |
| D. 165,691 | 1/1952 | Macomic | D86/10 |
| D. 238,972 | 2/1976 | Greene et al. | D86/10 G |
| 296,092 | 4/1884 | Weed . | |
| 297,391 | 4/1884 | Harman . | |
| D. 319,708 | 9/1991 | Cassai et al. | D28/7 |
| D. 406,921 | 3/1999 | Roeder | D28/7 |

(List continued on next page.)

FOREIGN PATENT DOCUMENTS

| | | |
|---|---|---|
| 27 37 667 | 2/1979 | (DE) . |
| 37 04496 | 10/1987 | (DE) . |
| 0 002 301 | 6/1979 | (EP) . |
| 53573 | 6/1982 | (EP) . |
| 0 119 506 | 2/1984 | (EP) . |
| 0 053 573 | 8/1984 | (EP) . |
| 0 163 323 | 9/1988 | (EP) . |
| 0 415 986 | 3/1991 | (EP) . |
| 0 640 302 | 3/1995 | (EP) . |
| 0 568 556 | 7/1995 | (EP) . |
| 0 764 410 | 3/1997 | (EP) . |
| 0 872 193 | 10/1998 | (EP) . |
| 682638 | 5/1930 | (FR) . |
| 2 285 101 | 4/1976 | (FR) . |
| 2 082 553 | 3/1982 | (GB) . |
| 2 097 662 | 11/1982 | (GB) . |
| 2 158 703 | 11/1985 | (GB) . |
| 2 195 883 | 4/1988 | (GB) . |
| 2 198 423 | 6/1988 | (GB) . |
| 2 312 617 | 11/1997 | (GB) . |
| WO 96/34546 | 11/1996 | (WO) . |
| WO 97/21554 | 6/1997 | (WO) . |
| WO 97/31553 | 9/1997 | (WO) . |
| WO 99/54151 | 10/1999 | (WO) . |

*Primary Examiner*—Gregory L. Huson
*Assistant Examiner*—Kathleen J. Prunner
(74) *Attorney, Agent, or Firm*—Pennie & Edmonds LLP

(57) ABSTRACT

The present invention is related to a durable foam tipped applicator that can absorb and retain fluids easily. The foam material used to make the applicator tip may be used in both water-based and solvent-based fluids. A wiper insert may be used to remove excess liquid from the applicator during removal from a reservoir of fluid. A lip at the mouth of the wiper insert can redirect excess fluid into the reservoir.

20 Claims, 9 Drawing Sheets

U.S. PATENT DOCUMENTS

| | | | |
|---|---|---|---|
| 565,328 | 8/1896 | Buhler . | |
| 571,367 | 11/1896 | Higgins . | |
| 599,461 | 2/1898 | Thomas . | |
| 634,606 | 10/1899 | Beeching . | |
| 716,619 | 12/1902 | Beeching . | |
| 717,180 | 12/1902 | Emmert . | |
| 732,877 | 7/1903 | Miner . | |
| 831,014 | 9/1906 | Leonard . | |
| 860,995 | 7/1907 | Ryan . | |
| 1,389,071 | 8/1921 | Pessels . | |
| 1,566,289 | 12/1925 | Stodola, Jr. . | |
| 1,811,612 | 6/1931 | Carpenter . | |
| 1,909,096 | 5/1933 | Cooney . | |
| 1,921,248 | 8/1933 | Carpenter . | |
| 1,962,875 | 6/1934 | Reber . | |
| 2,011,414 | 8/1935 | Oldham . | |
| 2,034,416 | 3/1936 | Peat . | |
| 2,168,179 | 8/1939 | Tobey . | |
| 2,282,406 | 5/1942 | Hollenbeck . | |
| 2,291,676 | 8/1942 | Baker . | |
| 2,314,539 | 3/1943 | Hollenbeck . | |
| 2,481,803 | 9/1949 | Weaver . | |
| 2,627,619 | 2/1953 | Gagen . | |
| 2,644,183 | 7/1953 | Kellett . | |
| 2,736,050 | 2/1956 | Lee . | |
| 2,753,582 | 7/1956 | Fredericks . | |
| 2,870,471 | 1/1959 | Albert . | |
| 3,059,262 | 10/1962 | Marschner . | |
| 3,087,191 | 4/1963 | Plunkett . | |
| 3,134,124 | 5/1964 | Horn . | |
| 3,146,806 | 9/1964 | Ginsburg . | |
| 3,175,025 | 3/1965 | Geen et al. . | |
| 3,214,778 | 11/1965 | Mathison . | |
| 3,215,263 | 11/1965 | Mathison . | |
| 3,280,421 | 10/1966 | Davidson . | |
| 3,298,054 | 1/1967 | Humble et al. . | |
| 3,372,424 | 3/1968 | Kellett . | |
| 3,494,702 | 2/1970 | Aston . | |
| 3,554,657 | 1/1971 | Aston . | |
| 3,562,838 | 2/1971 | Burton et al. . | |
| 3,684,387 | 8/1972 | Glenn | 401/122 |
| 3,724,018 | 4/1973 | Sills . | |
| 3,756,731 | 9/1973 | Aubry | 401/122 |
| 3,908,675 | 9/1975 | Spatz et al. | 132/82 R |
| 4,155,139 | 5/1979 | Corcoran . | |
| 4,194,848 | 3/1980 | Kingsford | 401/5 |
| 4,241,743 | 12/1980 | Schnabel et al. | 132/88.7 |
| 4,403,624 | 9/1983 | Montgomery | 132/88.7 |
| 4,407,311 | 10/1983 | Gueret | 132/88.5 |
| 4,433,928 | 2/1984 | Kingsford | 401/122 |
| 4,498,490 | 2/1985 | Seidler . | |
| 4,572,224 | 2/1986 | Rosenwinkel et al. . | |
| 4,609,300 | 9/1986 | Robert | 401/122 |
| 4,617,948 | 10/1986 | Gueret | 132/88.5 |
| 4,627,454 | 12/1986 | Dahm | 132/88.7 |
| 4,784,506 | 11/1988 | Koreska et al. | 401/132 |
| 4,784,602 | 11/1988 | Nitta . | |
| 4,810,122 | 3/1989 | Cole | 401/122 |
| 4,828,419 | 5/1989 | Porter et al. | 401/126 |
| 4,856,136 | 8/1989 | Janssen . | |
| 4,904,180 | 2/1990 | Nitta . | |
| 4,921,386 | 5/1990 | Hurrell | 401/126 |
| 4,923,317 | 5/1990 | Bishop et al. . | |
| 4,930,919 | 6/1990 | Gueret | 401/126 |
| 4,934,011 | 6/1990 | Haug . | |
| 4,955,745 | 9/1990 | Vauquelin | 401/119 |
| 4,974,980 | 12/1990 | Gueret | 401/119 |
| 5,002,415 | 3/1991 | Gueret | 401/126 |
| 5,022,559 | 6/1991 | Condon | 222/109 |
| 5,054,946 | 10/1991 | Morel | 401/122 |
| 5,061,103 | 10/1991 | Walsh-Smith | 401/122 |
| 5,084,931 | 2/1992 | Kühlcke . | |
| 5,097,853 | 3/1992 | Nehashi | 132/320 |
| 5,102,250 | 4/1992 | Gueret | 401/126 |
| 5,135,112 | 8/1992 | Kamen et al. | 206/581 |
| 5,145,358 | 9/1992 | Shike et al. . | |
| 5,433,782 | 7/1995 | Filbert et al. | 118/266 |
| 5,490,737 | 2/1996 | Gueret | 401/122 |
| 5,492,426 | 2/1996 | Gueret | 401/126 |
| 5,597,254 | 1/1997 | Vasas | 401/122 |
| 5,599,125 | 2/1997 | Vasas et al. | 401/122 |
| 5,716,150 | 2/1998 | Gueret | 401/129 |
| 5,743,279 | 4/1998 | Gueret | 132/118 |
| 5,803,638 | 9/1998 | Gueret | 401/122 |
| 5,855,715 | 1/1999 | Langford et al. . | |
| 5,873,669 | 2/1999 | Poore et al. | 401/122 |
| 5,875,791 | 3/1999 | Sheffler et al. | 132/218 |
| 5,899,622 | 5/1999 | Gueret | 401/122 |

FOAM APPLICATOR WITH WIPER INSERT

BACKGROUND OF THE INVENTION

1. Technical Field

The present invention concerns an improvement to containers used for liquids such as correction fluid and the like. In particular, the improvement provides a durable foam tipped applicator that can be used in either solvent-based fluids or water-based fluids. The foam tipped applicator absorbs and releases correction fluids easily without swelling or losing shape during immersion. The improvement also includes a more efficient container wiper against which an applicator may be wiped to remove excess liquid, thus preventing waste of the liquid and avoiding a common problem in which the container cannot be properly sealed due to excess liquid running onto and drying on the exterior of the container.

2. Discussion of the Related Art

Liquids and semi-liquids, such as correction fluid, cosmetics, paint, and the like are often stored in containers that include a reservoir for the liquid product and an applicator brush attached to the cap of the container. When the container is closed, the applicator brush is submerged in the reservoir of liquid. Upon removal from the reservoir, liquid product adheres to the applicator brush and is applied to a surface as desired by a user. However, if the amount of liquid withdrawn from the reservoir is not limited in some manner, frequently more liquid adheres to the brush than the user actually needs. As a result, when the user applies the brush to a surface the excess liquid is rapidly transferred to the surface, thereby diminishing the control or precision that can be achieved with the brush and also causing an undesirable build up of material on the coated surface and increased drying time. In circumstances where the desired area to be coated is small, these problems are noticeable even with small amounts of excess liquid.

Furthermore, the problems associated with excess liquid on the applicator are compounded when the liquid product is fast-drying. Unused portions of the product will dry-out and become unusable if not promptly returned to the reservoir. The buildup of dried and unusable product on the brush makes future applications less effective.

One attempt to solve the problems caused by excess liquid is to utilize a brushless applicator connected to a reservoir of liquid with a regulator to control the flow of fluid to the applicator tip. For example, U.S. Pat. No. 4,923,317 to Bishop et al. depicts a brushless correction fluid applicator having a reservoir of correction fluid permanently connected to a porous regulator of foamed or sponge-like material that controls flow of correction fluid to a flexible but fairly stiff plastic tip. In addition, U.S. Pat. No. 4,974,980 to Gueret describes a flexible, elastically deformable pen for liquid cosmetic products. The tip of the pen is conically shaped but has a cylindrical section at the end of the tip to provide greater precision during application, and is flocked with a fibrous material to hold the fluid to the surface of the tip.

The use of foam or sponge-like materials for brushless applicator tips, however, may present problems that do not occur with brushes. For instance, the foam material may not adequately absorb and release the fluid, may not retain its shape over extended periods of immersion or use, or may not recover quickly after drying. Furthermore, molded foam applicators used for application of powdered cosmetics commonly have seams. Such applicators are unsuitable for correction fluids because a seam would not allow the correction fluid to be applied evenly to the desired surface. In addition, because correction fluids may be water-based or solvent-based, foam materials immersed in such fluids may deteriorate rapidly.

Other attempts to reduce excess liquid on the applicator involve wiping the applicator and brush during and/or after withdrawal of the brush from the reservoir. The means employed is often in the form of a wiper insert placed in the neck of the container. Such wiper inserts usually are intended to strip the excess liquid from the brush as it is withdrawn from the reservoir. For example, U.S. Pat. No. 5,873,669 to Poore et al. describes a wiper insert having cleaning elements extending toward a reservoir within the container. The cleaning elements define a gap adapted for the frictional passage of the brush applicator. U.S. Pat. No. 4,886,080 to Cole depicts a wiper insert for a cosmetics container that includes at its lower end, near the reservoir, a "wiping orifice" to wipe cosmetics from the shaft and bristles of an applicator brush. In U.S. Pat. No. 4,761,088 to Zubek, a plurality of "tongues" protrude downward from the lower end of a wiper insert to perform the same function.

As explained in Poore et al., even after being wiped against the lower end of the wiper insert, usually more than enough liquid for the present application still adheres to the applicator. In such an event, the user typically wipes superfluous amounts of liquid off against the inside of the upper edge of the container opening. This can, however, lead to another problem if some of the liquid runs onto the exterior of the container. Most wiper inserts known in the art are not effective in preventing the liquid from running over when the brush is wiped against the upper edge of the wiper insert. When liquid runs over the upper edge of the wiper insert, it tends to run onto the closure threads of the container with which the container cap must interact to create a proper seal when the container is closed. If not removed, the liquid dries in place. Over time, the buildup of excess liquid will preclude proper closure of the container, thus allowing the liquid in the reservoir to dry-out or to spill if the container is tipped over. Even if the dried excess liquid does not preclude proper closure, it generally cannot be reclaimed, thus causing additional waste.

Another disadvantage inherent in most prior art wiper inserts is that users must exercise caution while re-inserting an applicator lest he or she accidentally brush liquid onto the exterior of the insert or neck of the container and cause additional buildup of product on the closure threads. This problem occurs because the inner diameter of the upper edge of most prior art wiper inserts is often no greater than the inner diameter of the central portion, and therefore only slightly greater than the diameter of the applicator brush used with the container.

Yet another problem inherent in most prior art wipers is that they frictionally engage with the applicator at all times. Such wiper inserts would be unsuitable for use with a foam applicator, however, because the wiper elements may cut or tear the applicator material or cause the material to wear out prematurely. These problems may be compounded if the wiper elements engage with the foam applicator at an obtuse angle.

There is thus a need in the art for a brushless applicator that is compatible with both solvent-based and water-based liquids, absorbs and releases fluids easily, retains its shape, and recovers quickly after drying. In addition, there is a need in the art for additional means with which to remove excess liquid from a brushless applicator in order to further preclude the accumulation of dried liquid product on the exterior of the container, and to provide facile re-insertion of the applicator into the container.

SUMMARY OF THE INVENTION

The present invention is directed to a brushless applicator suitable for use with correction fluids and a container insert for wiping excess liquid from a brushless applicator in such a manner as to avoid damaging the applicator, to prevent spillover of the liquid onto the exterior of the container, and to promote flow of excess liquid wiped from the applicator back into a container reservoir.

One embodiment of the invention is a container having a reservoir portion for containing correction fluid, a neck portion having an opening formed around a central axis and an applicator having a foam tip made of a material that is chemically inert in both water-based and solvent-based solutions. The foam tip material has a density from about 4 to about 7 pounds per cubic foot and has a porosity of from about 80 to about 130 pores per inch.

Another embodiment includes the neck portion of the container has a wiper insert around the neck portion of the opening of the container. The upper portion of the insert defines the inner diameter of the opening to the container and slopes inward and downward to a second inner diameter that is smaller than the first. The upper portion of the insert has a wiping lip that is shaped to direct excess fluid back into the container as it is removed from the applicator, while the lower portion of the insert has an annular wall for removing excess liquid from the applicator as it is removed from the container. In a preferred embodiment, the annular wall extends inward and downward until terminating at a rounded edge.

In another embodiment, the inner portion of the insert has at least one cleaning element that wipes excess fluid off the applicator as it is removed from the container. In yet another embodiment, the cleaning elements have the shape of prongs that extend toward the applicator to form an open and broken circle about the applicator. The diameter of the open and broken circle formed by the cleaning elements may be larger than the diameter of the applicator such that the cleaning elements do not contact the applicator during storage. In one embodiment, the cleaning elements are less than about 0.5 mm from the surface of the applicator. In another embodiment, the cleaning elements are approximately orthogonal to the axis of the applicator. The prong-shaped cleaning elements also may be separated from each other by sectional apertures. The cleaning elements also may flex or bend as the applicator is removed or inserted into the container.

In one embodiment of the invention, the foam tip is made of material having a density of from about 5.4 pounds per cubic foot to about 6.6 pounds per cubic foot. In yet another embodiment, the material for the foam tip has a porosity from about 85 to about 120 pores per inch. In another embodiment the material has a porosity of about 110 pores per inch. The material for the foam tip in another embodiment has a tensile strength of at least 20 psi. In yet another embodiment the material has a minimum elongation of 180 percent. In a preferred embodiment the material for the foam tip is polyester polyurethane.

BRIEF DESCRIPTION OF THE DRAWINGS

These and other features, aspects, and advantages of the present invention will become more readily apparent from the following detailed description, which should be read in conjunction with the accompanying drawings, in which.

DETAILED DESCRIPTION OF THE INVENTION

Figure 1:
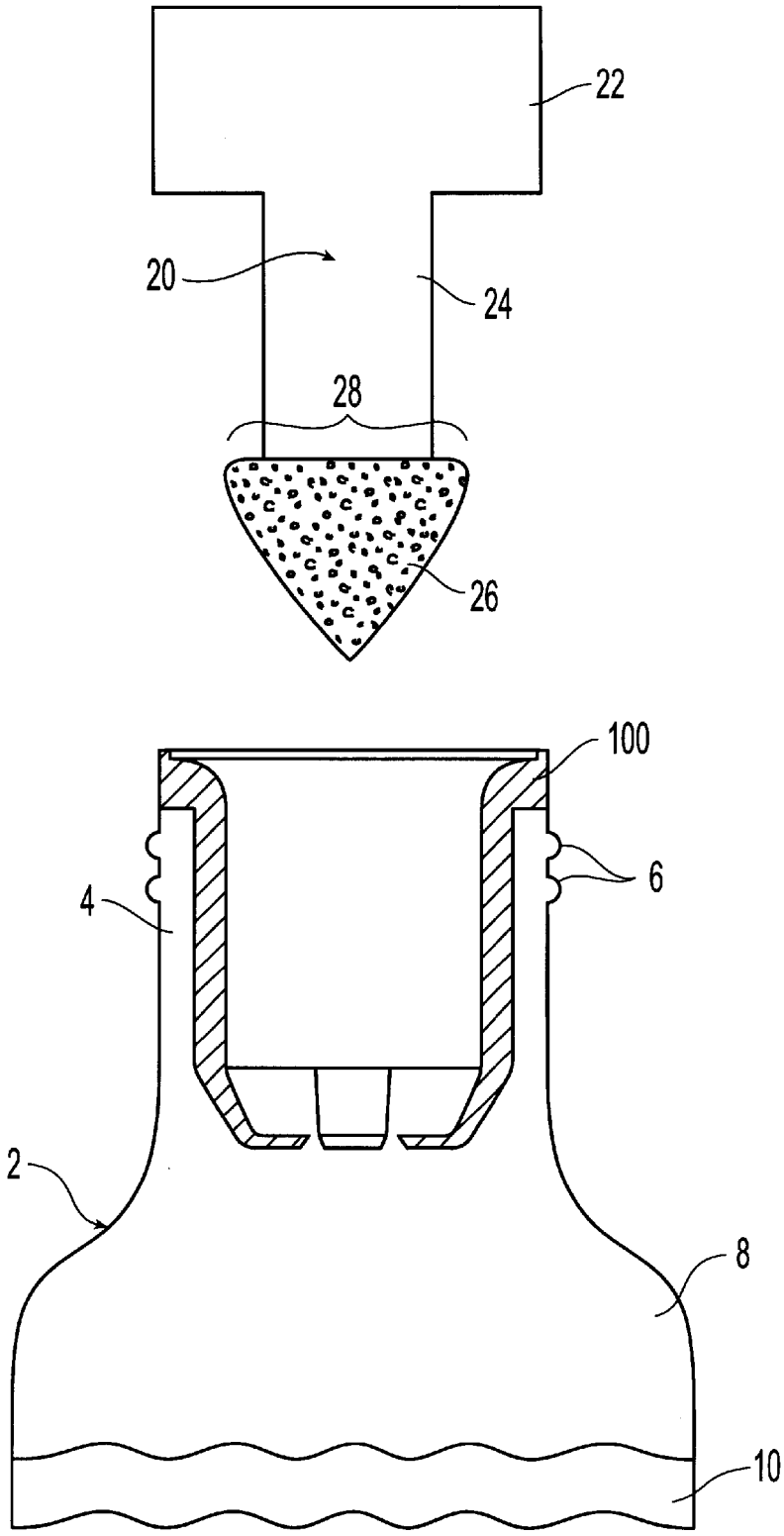
FIG. 1 depicts a partial cross section of a container, in an open configuration with a brushless applicator and a wiper insert for a brushless applicator inside the container in accordance with the present invention.

The following embodiments will be described in the context of a correction fluid container. Those skilled in the art, however, will recognize that the disclosed structures are readily adaptable for broader applications. Note that whenever the same reference numeral is repeated with respect to different figures, it refers to the corresponding structure in each figure.

FIG. 1 illustrates an embodiment of brushless applicator tip 26 and wiper insert 100 situated securely in place in the neck 4 of container 2. Wiper insert 100 is formed of an elastic material, such as polyethylene or the like, and is generally cylindrical in shape. The lower portion of container 2 forms reservoir 8, in which correction fluid 10 is stored. Applicator 20 is affixed to container cap 22 and comprises shaft 24 and applicator tip 26.

Applicator tip 26 is formed from a foam or sponge-like material that is substantially inert in both water-based and solvent-based solutions, i.e., any chemical activity between the material and the solution is minimal and does not adversely affect the solution or prematurely deteriorate the foam tip. For use in correction fluids, it is preferred that the foam or sponge-like material have a pore size from about 80 pores per inch to about 130 pores per inch, more preferably from about 85 pores per inch to about 120 pores per inch, and most preferably about 110 pores per inch. One skilled in the art, however, would recognize that the appropriate porosity of the applicator tip material will vary according to the physical properties and desired amount of the fluid to be applied. Suitable materials for use in forming an applicator tip for use in correction fluids may include polyurethane polymers, polystyrene, polyamide, polyester, polyether cellulose, phenolic, epoxy, polyolefin materials having a density from about 1 to about 10 pounds per cubic foot, more preferably having a density from about 4 to about 7 pounds per cubic foot, most preferably having a density from about 5.4 to about 6.6 pounds per cubic foot. A material with too low a density may lack sufficient structural integrity for the intended application, whereas a material with too high density may have no ability to hold or apply the fluid.

For correction fluids, it is preferred that brushless applicator tip 26 is formed of polyester polyurethane material. In a preferred embodiment, brushless applicator tip 26 is formed from a material sold under the trademark "Ultra Fine 2," which can be obtained from FOAMEX, located at 1500 East Second Street, Eddystone, Pa. 19018. In an alternative embodiment, brushless applicator tip 26 is formed from a material sold under the trademark "Ultra Fine 6," which is also available from FOAMEX.

Figure 5:
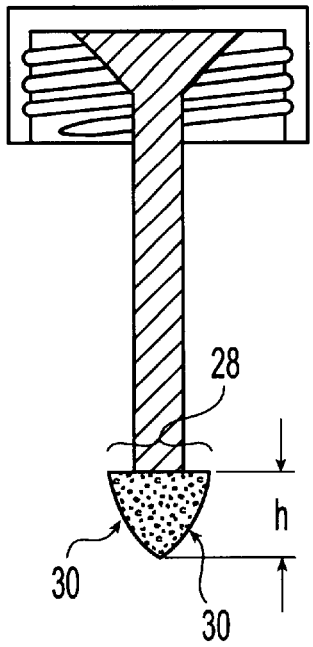
FIG. 5 is a longitudinal cross section of one embodiment of a brushless applicator in accordance with the present invention.
Figure 6:
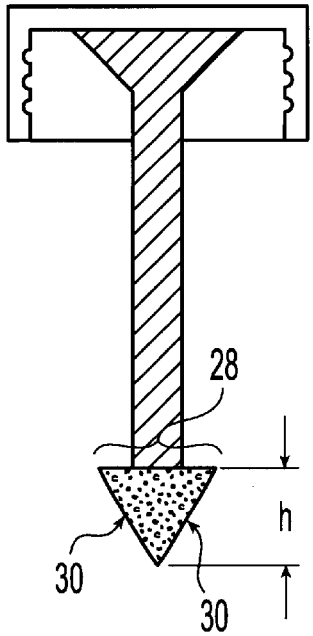
FIG. 6 is a longitudinal cross section of an alternative embodiment of a brushless applicator in accordance with the present invention.

For use in correction fluids, applicator tip 26 may have a wedge shape. Preferably, the width of base 28 of wedge-shaped applicator tip 26 (FIGS. 5 and 6), is from about ¼ to about ½ of the altitude, h, of the wedge, more preferably from about ¼ to about ⅓ of the altitude of the wedge. The sides 30 of the wedge-shaped applicator tip 26 that are used to apply correction fluid (see FIGS. 5 and 6) may be straight or curved to provide increased durability, more uniform coverage of liquid and/or greater precision for the user. In one preferred embodiment, the sides 30 are slightly convex (FIG. 6).

The base 28 of applicator tip 26 is preferably affixed to shaft 24 by thermal melt fusion, although one skilled in the art would appreciate that other bonding methods, such as adhesive bonding, solvent bonding and other welding methods may also be suitable.

Figure 2:
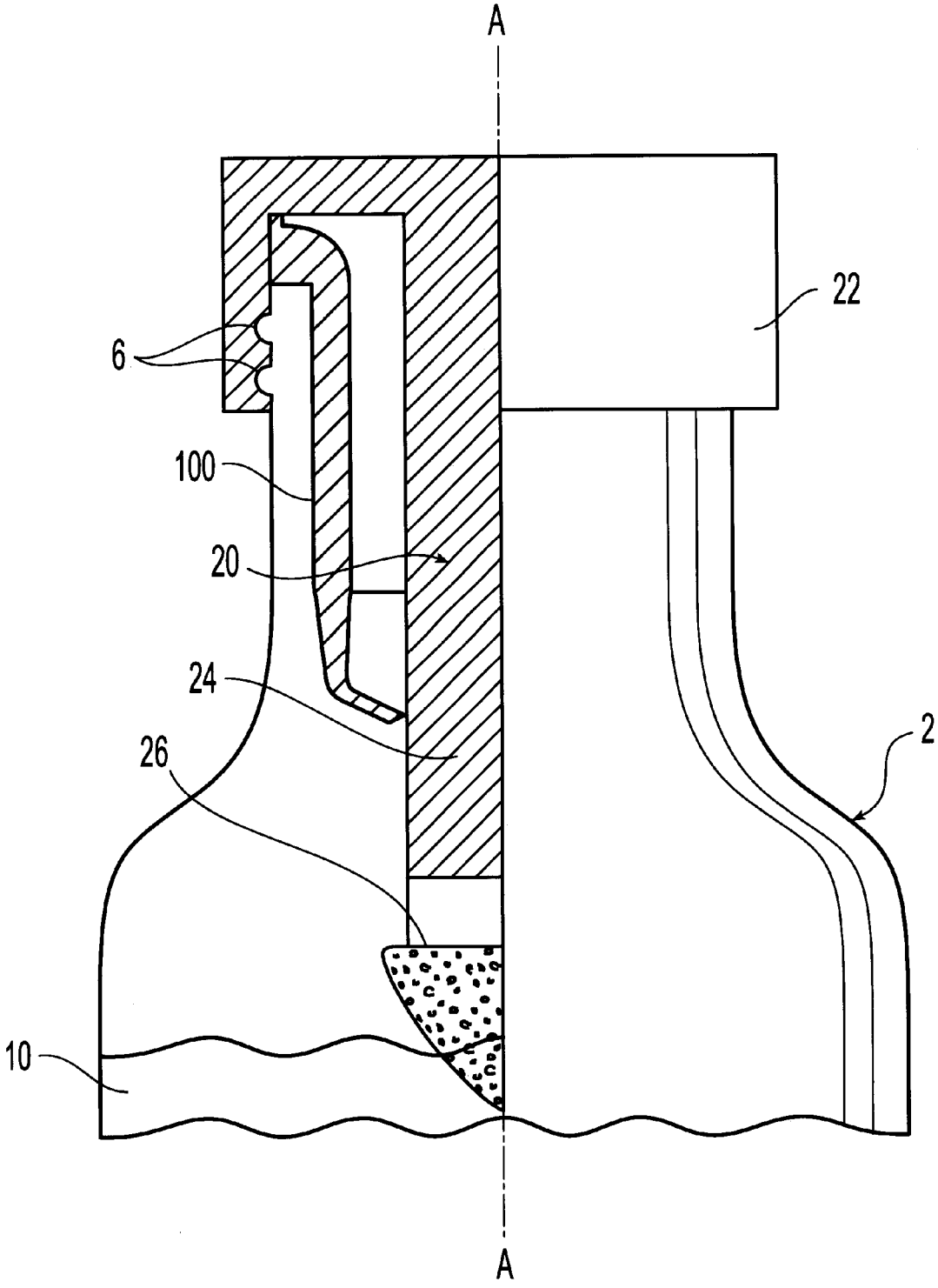
FIG. 2 depicts a partial cross section of a container in a closed configuration with a brushless applicator immersed in the reservoir of fluid and a wiper insert in accordance with the present invention.

When container 2 is closed, as depicted in FIG. 2, brushless applicator 26 is immersed in correction fluid 10 and cap 22 releasably interlocks with threads 6 on the exterior of neck 4.

Figure 3A:
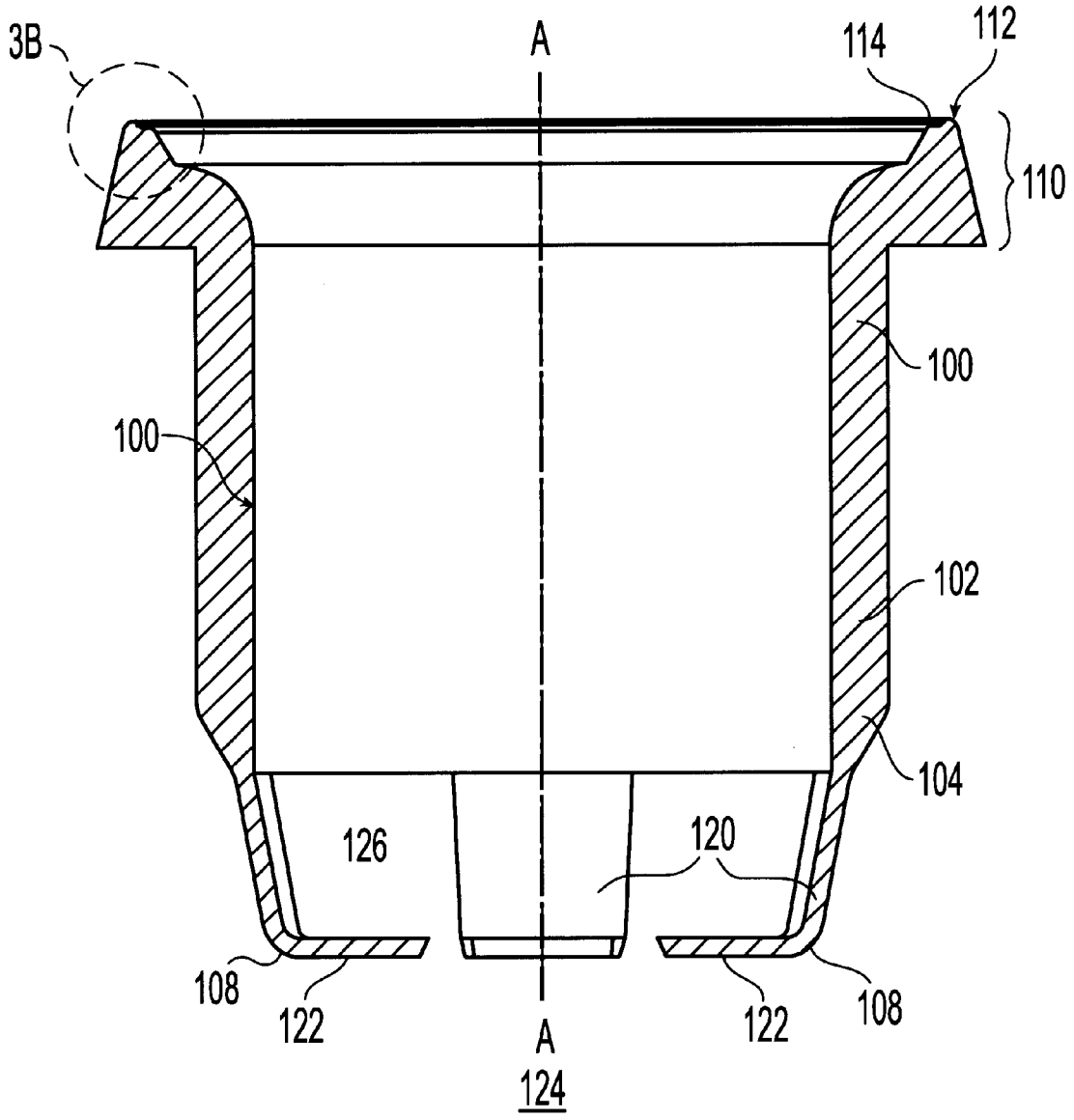
FIG. 3A is a longitudinal cross-section of one embodiment of a wiper for a brushless applicator in accordance with the present invention.
Figure 3B:
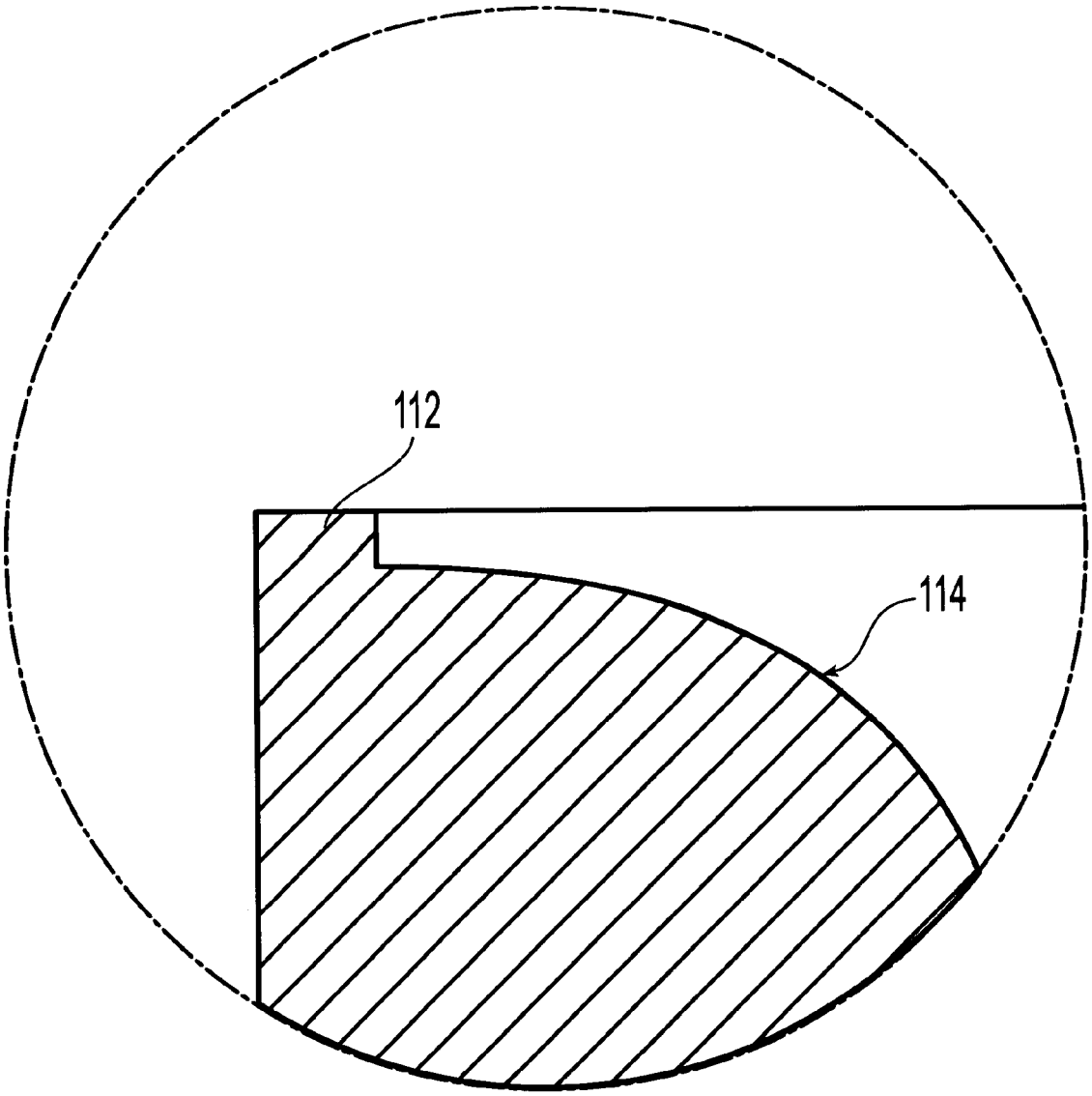
FIG. 3B is a magnified view of the lip at the upper end of the embodiment featured in dotted circled in FIGS. 3A and 7.
Figure 3C:
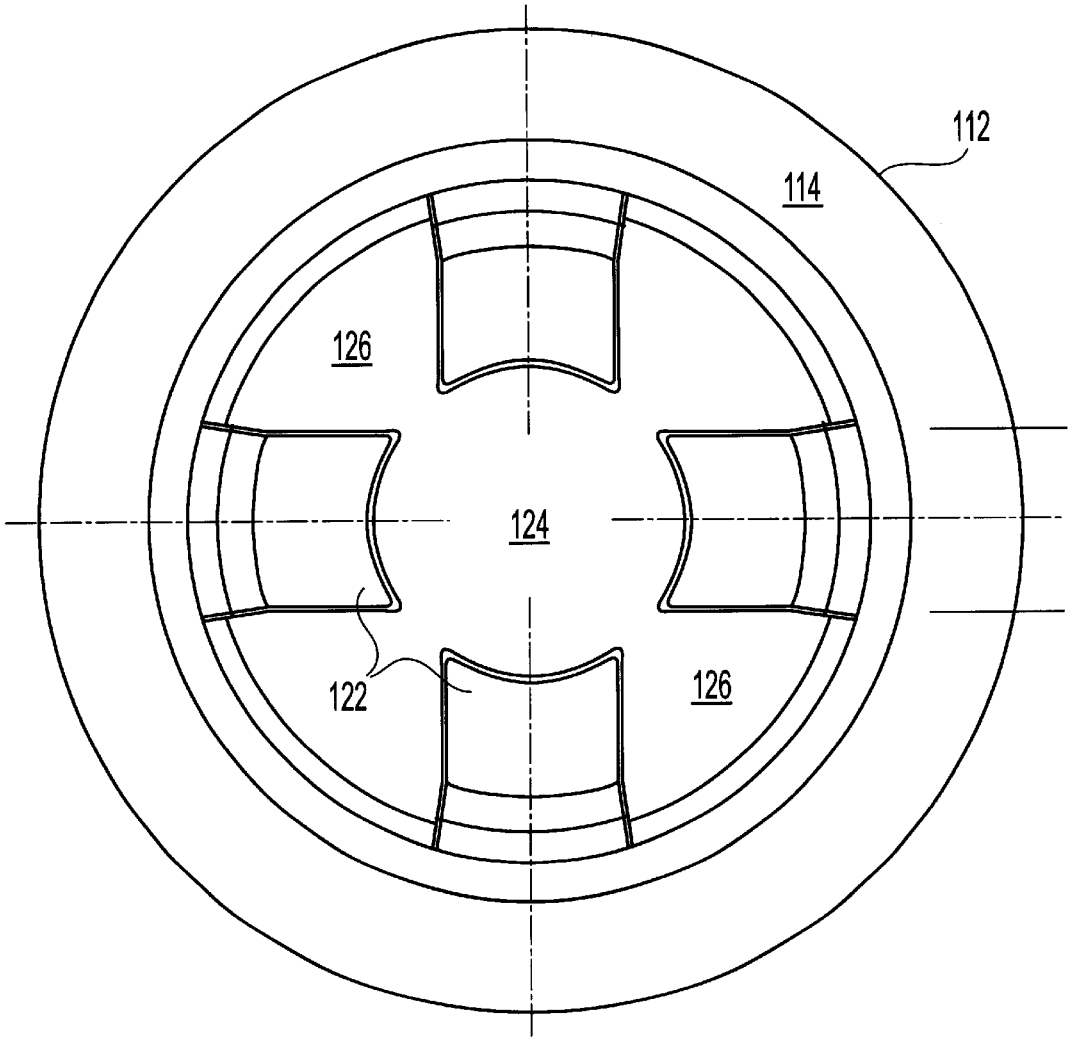

With reference now to FIGS. 3A, 3B and 3C, it can be seen that wiper insert 100 is generally cylindrical in shape about a central axis A. Wall 102 is substantially parallel to axis A along a central portion of wiper insert 100.

Figure 7:
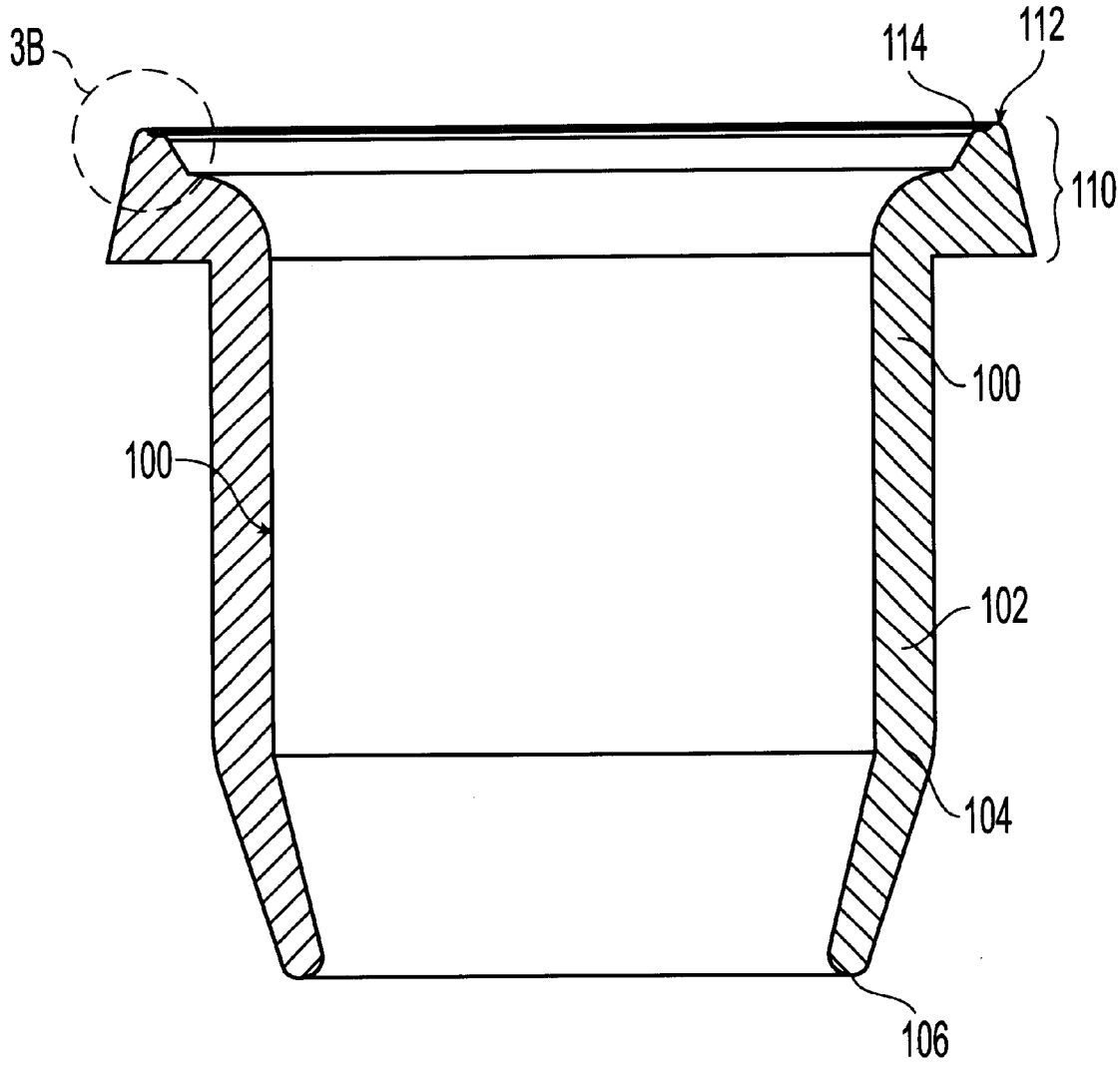
FIG. 7 is a longitudinal cross-section of one embodiment of a wiper for a brushless applicator in accordance with the present invention.

The lower end of wiper insert 100 includes the bottom of wall 102, which is marked by first bevel 104. In a preferred embodiment, bevel 104 extends inward and downward until terminating at a rounded edge 106 (FIG. 7). The lower end of insert 100 also may include a plurality of, illustratively four, prong-shaped cleaning elements 120, arranged about central axis A, and made of a flexible and resilient material such as, for example, polyethylene. Prongs 120 are connected to and dependent from the interior of wall 102 and extend obliquely inward and downward from wall 102 toward axis A for a distance of from about 1 mm to about 5 mm, preferably about 2 mm. The lower end of prongs 120 are turned, marked as second bevel 108, so that prongs 120 extend toward axis A, preferably in a plane approximately orthogonal to axis A. The prongs 120 terminate short of axis A. Lower end 122 of prongs 120, in one illustrative embodiment, do not connect to each other, but instead form a broken ring to define a circular gap 124 through which applicator 20 passes (best shown in FIG. 3C). It will be understood by one of skill in the art that gap 124 may be other than circular in appearance, depending upon the cross-sectional shape of applicator 20 and/or the pattern in which excess correction fluid is to be wiped from the applicator.

Gap 124 allows passage of applicator tip 26 and shaft 24 of applicator 20. During insertion and removal of applicator 20, it is preferred that prongs 120 flex about first bevel 104 and second bevel 108 in a direction radially outward and away from axis A upon contact with shaft 24 or applicator tip 26. When applicator 20 is withdrawn from reservoir 8, shaft 24 and applicator tip 26 necessarily wipe against prongs 120, thus removing an initial amount of excess liquid. Although prongs 120 may be configured to frictionally contact shaft 24 and applicator tip 26 at all times when applicator 20 is within container 2, it is preferred that prongs 120 are configured to be less than about 0.5 mm from shaft 24, thereby reducing potential tearing of applicator tip during use but nevertheless allowing excess fluid may to be wiped from shaft 24 and applicator tip 26. Between prongs 120 are open spaces 126 through which excess liquid may drain into reservoir 8 (best shown in FIG. 3C). Spaces 126 are wedge-like in shape when viewed from above, wider at second bevel 108 and tapering as prongs 120 converge toward axis A. Thus, prongs 120 form an open and broken circle about the central axis and are separated from each other by sectional apertures formed by spaces 126. As described below, when additional fluid is wiped off applicator 20 against the upper end of wiper insert 100, the excess fluid flows down wall 102 through spaces 126 and returns to reservoir 8.

Figure 4A:
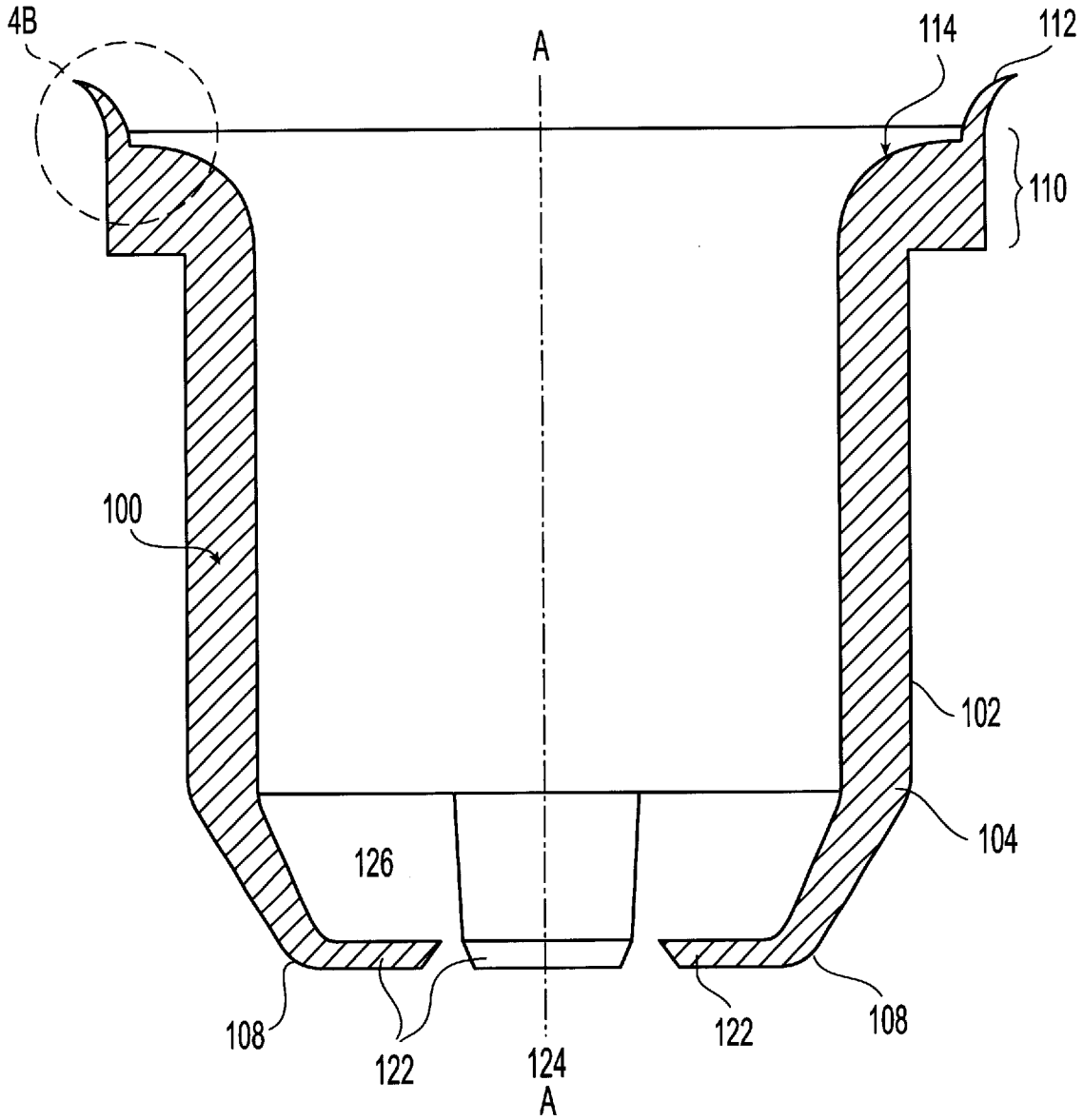
FIG. 4A is a longitudinal cross-section of an alternative embodiment of a wiper insert for a brushless applicator in, accordance with the present invention.
Figure 4B:
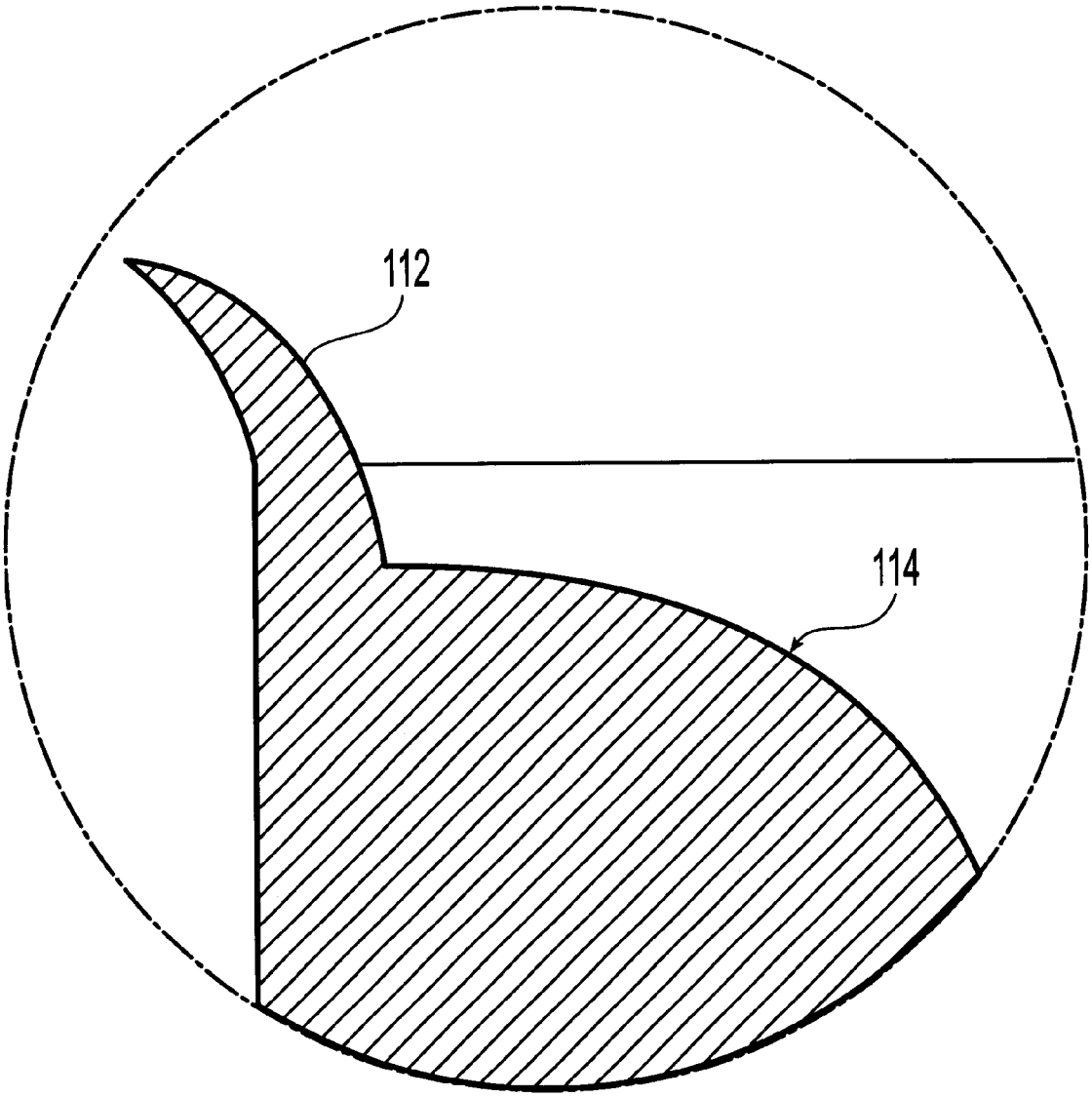
FIG. 4B is a magnified view of the lip at the upper end of the alternative embodiment featured in dotted circles in FIG. 4A.

The upper portion of insert 100 forms peripheral annular flange 110 which engages and seats against the top of neck 4 of container 2, as shown in FIGS. 1 and 2. Lip 112 is in the form of a protruding structure extending upward from flange 110, preferably either substantially parallel to or angled away from central axis A. In an illustrative embodiment, depicted in FIGS. 3A and 3B, lip 112 is substantially perpendicular to flange 110 or parallel to central axis A. In an alternative embodiment, depicted in FIGS. 4A and 4B, lip 112 extends curvedly upward and outward from axis A at approximately a 45° angle. As may be appreciated with reference to FIG. 4B, the curved upward and outward shape of lip 112 causes at least a portion of the outer surface of flange 110 to be substantially concave.

Even after scraping against cleaning prongs 120, as it is withdrawn from reservoir 8, applicator 20 may contain more correction fluid than the user needs. The purpose of lip 112 is to provide an edge against which applicator 20 can be wiped to remove this excess fluid. Lip 112 directs the wiped off fluid toward the interior of insert 100 rather than allowing it to spill over to container threads 6.

Inwardly sloping inner circumference 114 slopes from a wider dimension proximate to lip 112 toward a narrower dimension where it meets the interior of wall 102. Circumference 114 defines the inner circumference of flange 110 and directs excess liquid from lip 112 toward the central portion of insert 100 and reservoir 8. The inner diameters of lip 112 and the top of circumference 114 are greater than the inner diameter of the central portion of insert 100. In an illustrative embodiment, circumference 114 presents a convex appearance when viewed cross-sectionally. Thus, upon re-insertion of applicator 20 into container 2, the applicator is guided toward central axis A and wall 102 by circumference 114, then, at wall 102, downward and substantially parallel to central axis A, until it passes between prongs 120.

The above description is intended to be illustrative, not limitive. Thus, it will be apparent to those skilled in the art that modifications may be made to the invention as described without departing from the scope of the claims set out below.

We claim:

1. A container for the storage of a correction fluid and adapted to be used with an applicator inserted through a container opening, said container comprising:

(a) a reservoir portion for containing fluid;

(b) a neck portion defining an opening to said reservoir portion, said opening being formed around a central axis (c) an applicator, said applicator including a foam tip, wherein said foam tip is made of material that is chemically inert in both water-based and solvent-based solutions, has a density from about 4 to about 7 pounds per cubic foot, and has a porosity of from about 80 to about 130 pores per inch.

2. The container according to claim 1, wherein said neck portion includes a wiper insert disposed annularly around said opening and central axis, wherein said wiper insert comprises:

an upper opening portion defining said opening to the outside of said container and having a first inner diameter sloping inward and downward to a second inner diameter smaller than said first inner diameter;

an annular wiping lip in the form of a protruding structure extending upward from and surrounding said upper opening portion at said first inner diameter of said upper portion, said wiping lip and said upper portion being shaped to direct excess fluid wiped onto said wiping lip into said reservoir so that fluid does not remain on said insert; and an inner portion disposed below the upper opening portion, said inner portion including an annular wall shaped for removing excess liquid from the applicator passed therethrough.

3. The container according to claim 2, further comprising at least one cleaning element connected to said inner portion and shaped to wipe excess fluid off said applicator withdrawn through said wiper insert.

4. The container according to claim 3, wherein said at least one cleaning element comprises a plurality of cleaning elements in the shape of prongs having upper ends connected to said wiper insert and lower ends extending toward said applicator and forming an open and broken circle about the central axis of said applicator.

5. The container according to claim 4, wherein said plurality of cleaning elements are approximately orthogonal to the axis of said applicator.

6. The container according to claim 4, wherein said prongs are separated from each other by sectional apertures.

7. The container according to claim 4, wherein said prongs can flex or bend as the applicator is removed or inserted into the container.

8. The container according to claim 4, wherein the diameter of the open and broken circle formed from the plurality of cleaning elements is larger than the diameter of the applicator.

9. The container according to claim 8, wherein the lower ends of the prong-shaped plurality of cleaning elements are less than about 0.5 mm from the surface of the applicator.

10. The container according to claim 2 further comprising a bevel at the lower end of the annular wall shaped for removing excess liquid from the applicator, wherein said bevel slopes inward and downward until terminating at a rounded edge.

11. The container according to claim 1, wherein said foam tip is made of material having a density of from about 5.4 pounds per cubic foot to about 6.6 pounds per cubic foot.

12. The container according to claim 1, wherein the material for said foam tip has a porosity from about 85 to about 120 pores per inch.

13. The container according to claim 12, wherein the material for said foam tip has a porosity of about 110 pores per inch.

14. The container according to claim 1, wherein the material for said foam tip has a tensile strength of at least 20 psi.

15. The container according to claim 1, wherein the material for said foam tip has a minimum elongation of 180 percent.

16. The container according to claim 1, wherein the material for said foam tip is polyester polyurethane.

17. A container for the storage of a correction fluid and adapted to be used with an applicator inserted through a container opening, said container comprising:

(a) a reservoir portion for containing fluid;

(b) a neck portion defining an opening to said reservoir portion, said opening being formed around a central axis; and (c) an applicator, said applicator including a foam tip, wherein said foam tip has a density from about 4 to about 7 pounds per cubic foot and a minimum elongation of 180 percent.

18. The container according to claim 17, wherein the material for said foam tip has a tensile strength of at least 20 psi.

19. The container according to claim 18, wherein said neck portion includes a wiper insert disposed annularly around said opening and central axis, wherein said wiper insert comprises:

an upper opening portion defining said opening to the outside of said container and having a first inner diameter sloping inward and downward to a second inner diameter smaller than said first diameter;

an annular wiping lip in the form of a protruding structure extending upward from and surrounding said upper opening portion at said first inner diameter of said upper portion, said wiping lip and said upper portion being shaped to direct excess fluid wiped onto said wiping lip into said reservoir so that fluid does not remain on said insert; and an inner portion disposed below the upper opening portion, said inner portion including an annular wall shaped for removing excess liquid from the applicator passed therethrough.

20. The container according to claim 19, wherein the material for said foam tip has a porosity from about 80 to about 130 pores per inch.

* * * * *

UNITED STATES PATENT AND TRADEMARK OFFICE
Certificate

Patent No. 6,238,116 B1 Patented: May 29, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gary R. Ashe, Sanborn, NY (US); Roger F. Lockshier, Monroe, CT (US); James Whitaker, Jr., New Haven, CT (US); Scott Poore, Simpsonville, SC (US); Kevin Wilson, Gray Court, SC (US); Derrick Jakubchak, Simpsonville, SC (US); and Larry Thomas, Spartanburg, SC (US).

Signed and Sealed this Fifth Day of January 2010.

GREGORY L. HUSON
*Supervisory Patent Examiner*
Art Unit 3751